US005398465A

United States Patent [19]

Tagg

[11] Patent Number: 5,398,465

[45] Date of Patent: Mar. 21, 1995

[54] CABIN

[75] Inventor: Richard L. Tagg, Sandhutton, United Kingdom

[73] Assignee: Portasilo Limited, United Kingdom

[21] Appl. No.: 8,654

[22] Filed: Jan. 21, 1993

[30] Foreign Application Priority Data

Oct. 15, 1992 [GB] United Kingdom ..... 9221608.4

[51] Int. Cl.[6] ..... A47K 4/00

[52] U.S. Cl. ..... 52/79.1; 52/34; 49/386; 4/449; 4/460

[58] Field of Search ..... 4/449, 459, 460, 474, 4/476, 479, 482; 49/386; 52/34, 79.1

[56] References Cited

U.S. PATENT DOCUMENTS

| | | | |
|---|---|---|---|
| 3,074,076 | 6/1963 | Kersten | 4/459 |
| 3,447,167 | 6/1969 | Harding | 52/34 X |
| 4,031,572 | 6/1977 | Harding | 52/79.1 |
| 4,158,271 | 6/1979 | Barry | 49/386 |
| 4,238,858 | 12/1980 | Maihart | 52/79.1 X |
| 4,305,164 | 12/1981 | Sargent et al. | 52/34 X |
| 4,493,118 | 1/1985 | Braxton | 4/459 X |
| 4,744,111 | 5/1988 | Tegg et al. | 4/460 |
| 4,918,765 | 4/1990 | Harding | 4/460 |
| 5,093,941 | 3/1992 | Müller | 52/79.1 X |

FOREIGN PATENT DOCUMENTS

| | | | |
|---|---|---|---|
| 0257927 | 3/1988 | European Pat. Off. . | |
| 2521848 | 8/1983 | France | 4/460 |
| 4-213637 | 8/1992 | Japan | 4/460 |
| 1180566 | 2/1970 | United Kingdom . | |
| 1198619 | 7/1970 | United Kingdom | 52/79.1 |
| 1192654A | 1/1988 | United Kingdom . | |

OTHER PUBLICATIONS

United Kingdom Search Report on Application No. GB 9221608.4; dated Jan. 24, 1994.

United Kingdom Search Report on Application No. GB 9221601.9; dated Jan. 24, 1994.

United Kingdom Search Report on Application No. GB 9221647.2; dated Jan. 19, 1994.

*Primary Examiner*—Carl D. Friedman
*Assistant Examiner*—Kevin D. Wilkens
*Attorney, Agent, or Firm*—Kelly, Bauersfeld & Lowry

[57] ABSTRACT

A cabin comprising a base structure, a wall structure and a roof structure, wherein the wall structure comprises two opposed side wall members which define two opposite side walls of the cabin and which each provide a pair of corners and a pair of return walls which define a part of front and rear walls of the cabin, the space between the rear return walls being closed by a rear wall member and the space between the front return walls being closable by a door.

17 Claims, 11 Drawing Sheets

25
25a
24
21
11
24a
25c
25b
25d
18
60
50
13
30
61
62
32a
34a

CABIN

BACKGROUND OF THE INVENTION

This invention relates to a cabin for a portable toilet or other relocatable building structures.

SUMMARY OF THE INVENTION

An object of the invention is to provide a new or improved cabin.

According to one aspect of the invention I provide a cabin comprising a base structure, a wall structure and a roof structure, wherein the wall structure comprises two opposed side wall members which define two opposite side walls of the cabin and which each provide a pair of corners and a pair of return walls which define a part of front and rear walls of the cabin, the space between the rear return walls being closed by a rear wall member and the space between the front return walls being closable by a door.

The distance between the rear return walls may be the same as the space between the front return walls.

The cabin may include a rear wall frame within which the rear wall member is disposed.

The rear wall frame may be connected to the rear wall member and to the rear return walls.

The cabin may comprise a door frame defining an opening which is closable by the door.

The door frame may be connected to the front return walls.

The rear wall frame and the door frame may be of the same dimensions.

The rear wall frame and the door frame may extend above the top of the front and rear return walls and may have a top portion which is connected to the roof structure.

The roof structure may be connected to inwardly inset portions of the side wall members which project above the top of the side walls.

Said inwardly inset portions may have outwardly extending projecting parts which engage with the roof structure and to which the roof structure is secured by suitable fastening means.

A space may be provided between the outwardly projecting portions and adjacent parts of the roof structure and the inwardly inset portion to provide ventilation channels between the interior of the cabin and the exterior.

The base structure may comprise a generally rectangular frame to which the side wall members and rear wall member are fastened and may comprise a floor panel which projects forwardly of a front member of the frame.

The side wall members may be provided with recessed vertically extending channel portions to provide hand engageable portions to facilitate manipulation of the unit.

The rear wall frame may be provided with a generally channel-shaped portion in which outwardly projecting flange portions of the side wall members and rear wall member and roof member are received in side-by-side relationship.

Suitable fastening means may be passed through side walls of the channel and the adjacent flange portions.

The side wall members, rear wall member and door may be vertically arranged with the rear wall member and the door, when closed, arranged at right angles to the side walls.

The side wall members and rear wall member may be made from relatively thin plastics sheet material by vacuum forming or rotational forming.

The rear wall frame and door frame may be made of an aluminium extrusion, preferably the rear wall frame is a plastics extrusion and the door frame is an aluminium extrusion.

The door may comprise a vacuum formed double skin door with the skins of the door being held in a frame made of for example aluminium.

The frame may comprise a pair of generally channel-shaped members, one arranged to be received within the other with the skins of the door sandwiched therebetween.

The free edges of the return front and side walls of each side wall panel may have said flange extending outwardly generally perpendicular thereto.

The rear wall member, along its vertical side edges and top edge, may likewise be provided with said flange which extends generally perpendicularly to the remainder of the rear wall member.

The side wall members, rear wall member and door may be formed with horizontally extending channels which extend inwardly thereof relative to the interior of the enclosure to rigidify the cabin.

The roof member may have a generally flat main part with a peripheral flange and downwardly extending flange formed at the periphery which overlies inwardly offset upper edge portions of the side wall members.

The peripheral flange of the roof may be provided with recessed parts, to receive the rear wall frame and door frame.

The recesses part may be provided with a generally outwardly extending flange for joining to the rear wall frame and door frame.

The cabin may be provided with suitable sanitary equipment to adapt it for use as a portable toilet.

The sanitary equipment may comprise a W.C., and/or a hand wash basin and/or shower and/or equipment for disabled persons may be provided.

According to a second aspect of the invention, the cabin may comprise a base structure, a wall structure and a roof structure wherein the wall structure comprises a door pivotally connected in a door frame and torsion spring means being provided to bias said door towards a closed position.

The torsion spring means may comprise a main part extending generally parallel to the axis of pivot of the door and first and second transversely extending parts disposed at opposite ends of the main part and extending transversely away therefrom and being in abutting relationship with the door and cabin respectively so as to bias the door towards said closed position.

The door may comprise an edge member having a longitudinally extending groove in which said main part is received.

The edge member may comprise an extrusion of, for example, aluminium.

The edge member may be of generally channel shape having said groove provided in the outwardly facing surface of the base part of the channel.

The main part of the torsion spring may be retained in said groove by retaining means, and preferably by virtue of being trapped therein by at least one hinge member secured to the outwardly facing surface of the base part of the channel.

The first transversely extending part may extend through an opening in the wall of the groove.

The second transversely extending part of the torsion spring means may be provided with a stop means to limit opening of the door.

The stop means may comprise a third part which extends transversely to the second part and is adapted to engage an abutment on the cabin.

The door may be provided with a further edge member of channel configuration arranged to be disposed within the channel of the first mentioned edge member with inner and outer skins of door panels sandwiched therebetween and the edge members of the door being fastened together.

In this case the first transversely extending part may extend through an opening in the base of the further edge member and be in abutting relationship with an inwardly facing surface of one side wall of the generally channel shaped further edge member.

The second transversely extending member may be fixed to the undersurface of the floor structure.

According to a third aspect of the invention I provide a portable toilet cabin comprising a toilet bowl having a discharge outlet and an inlet for liquid to flush the bowl, a sink having a discharge outlet and an inlet for liquid to be received in the sink, a first tank for receiving material discharged from said discharge outlet of the toilet bowl, a second tank for receiving material discharged from said discharge outlet of the sink, a third tank for fresh water, means to feed fresh water from the third tank to the inlet of the sink, means to feed water discharged from the discharge outlet of the sink to the second tank and means to feed water from the second tank to the inlet of the toilet bowl to flush the toilet bowl.

The cabin may be provided with a floor and the third tank may be disposed under the floor.

The second tank may be disposed under the sink.

Alternatively, the cabin may be provided with a floor and the second tank may be disposed under the floor.

In this case the third tank may be disposed under the sink.

In both alternatives the first tank may be disposed under the toilet bowl.

A first pump, which may be a foot pump or a hand pump, may be provided to pump water from the third tank to the sink basin inlet.

A second pump, which may be a foot pump or a hand pump, may be provided to pump water from the second tank to the toilet bowl inlet.

According to a fourth aspect of the invention I provide a portable toilet cabin comprising a toilet bowl having a discharge outlet, means defining an enclosure above which the toilet bowl is supported and the toilet bowl being adapted to provide either of:

(1) a direct discharge from said discharge outlet into the enclosure; or (2) discharge from said discharge outlet into a duct which isolates the discharge outlet from the enclosure and feeds material discharged from the discharge outlet to a position remote from the enclosure.

The duct may be connected to a sewage disposal system.

The sewage disposal system may comprise a mains disposal system or a local sewage disposal system such as a septic tank or a cesspit.

By providing such an enclosure by which the toilet bowl is supported, the same components are required irrespective of whether the toilet bowl is to be discharged into the enclosure, which then provides a soil tank, or whether the toilet bowl is to be discharge to a mains or local sewage disposal system.

The present invention therefore avoids the need to provide different modules to be fitted inside the portable toilet cabin to provide different functions. In addition, the enclosure provides structural integrity to the structure.

The enclosure may comprise a moulding of synthetic plastics material and may be of generally right parallelepiped configuration.

The features of the second more specific aspect of the invention may be provided in combination with, or alternative to, the features of the first more specific aspect.

BRIEF DESCRIPTION OF THE DRAWINGS

The invention will now be described in more detail by way of example only with reference to the accompanying drawings, wherein.

DESCRIPTION OF THE PREFERRED EMBODIMENTS

Figure 1:
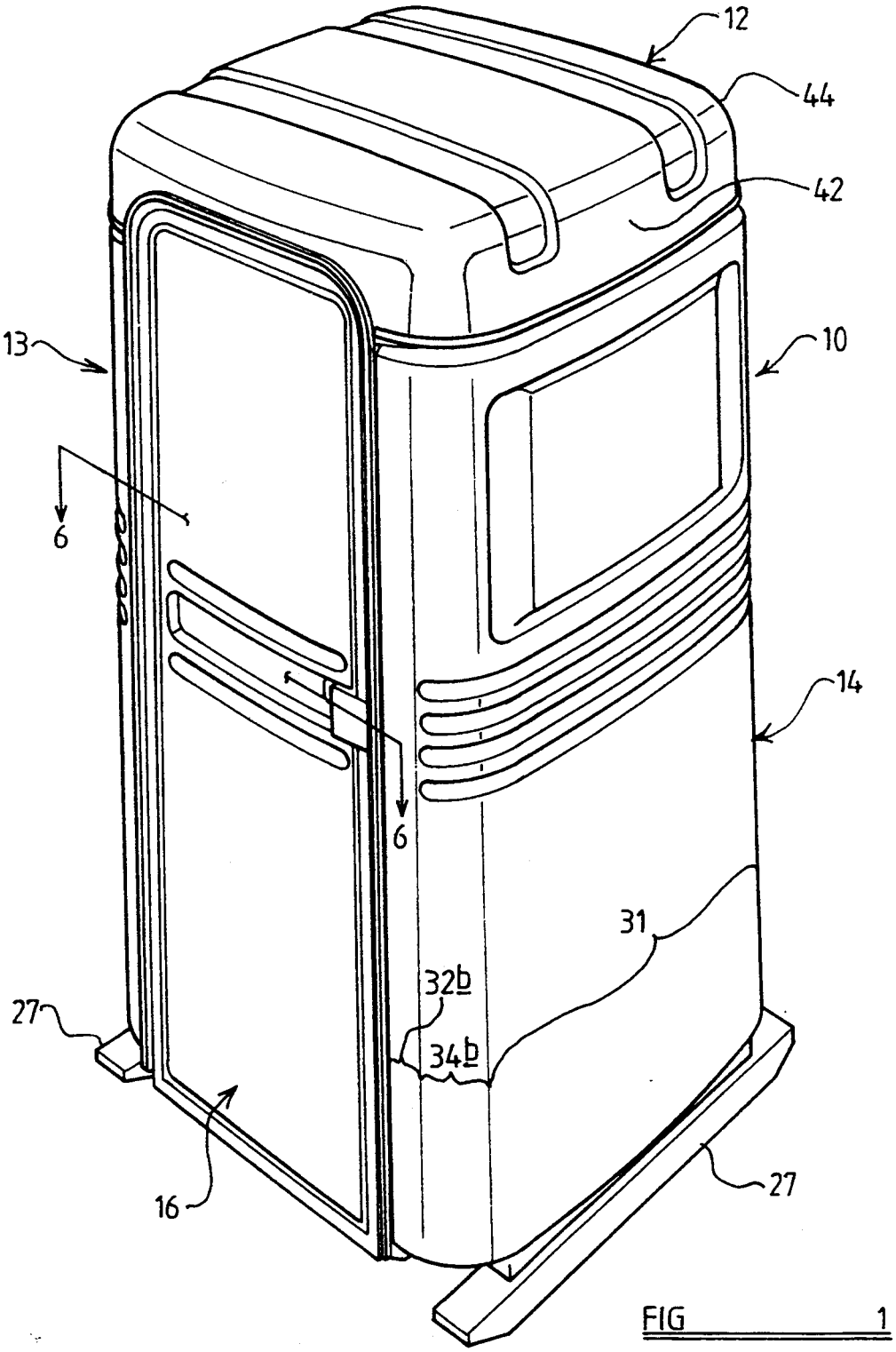
FIG. 1 is a perspective view of a cabin embodying the invention.
Figure 1A:
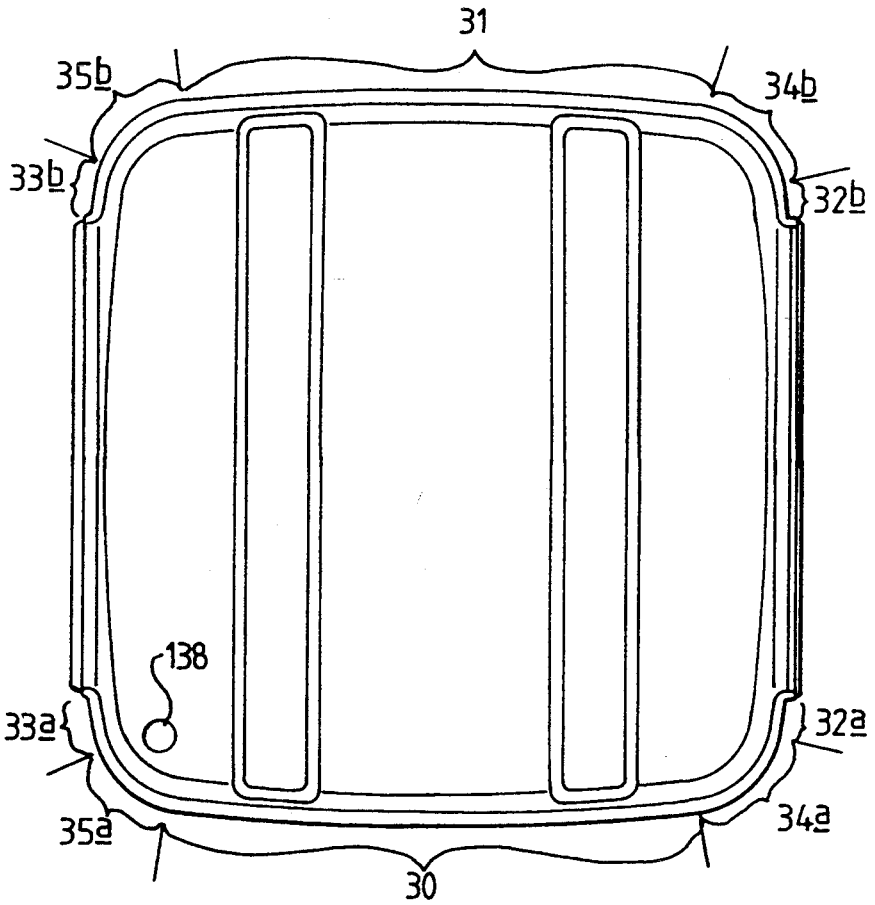
FIG. 1*a* is a plan view of the cabin of FIG. 1.

Referring to the drawings, a cabin 10 is illustrated fitted out to provide a portable, relocatable, toilet.

Figure 2:
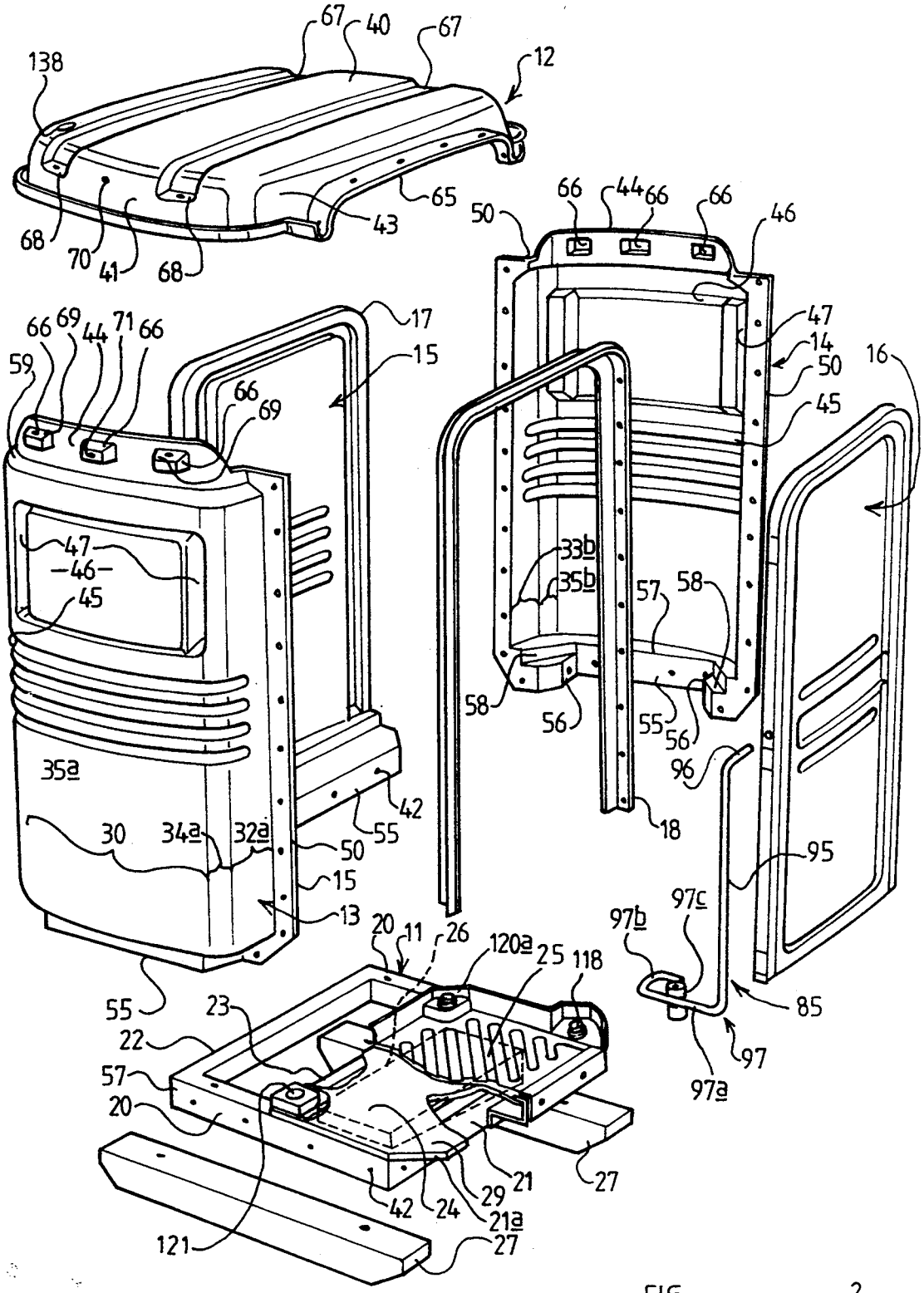
FIG. 2 is an exploded perspective view, with parts omitted, of the cabin of FIG. 1.

The cabin 10, as best shown in FIG. 2, comprises a base frame 11, a roof member 12, a first side wall member 13, a second, identical and oppositely disposed side wall member 14, a rear wall member 15 and a door member 16. These basic components are assembled together with the aid of a rear wall frame 17 and a door frame 18 and appropriate fasteners to form a basic cabin construction. The rear wall frame 17 is made of a synthetic plastics extrusion such as rigid polyethylene but may be made of an aluminium alloy extrusion or in other suitable manner. The door frame 18 is made as an aluminium alloy extrusion or in other suitable manner.

The rear wall frame 17 provides a "skid" facility upon which the load of the cabin may be taken when the cabin is discharged, for example, from the back of a lorry thereby avoiding damage to the wall panels or door of the unit and because the frames are relatively rigid, risk of damage to the frame or other parts of the cabin is minimised.

The base frame 11 is made by suitably jointed timber elements and comprises side beams 20 interconnected by a front beam 21, a rear beam 22 and an intermediate beam 23. A plywood floor panel 24 is disposed on top of the frame and extends from the intermediate beam 23 so as to overhang and project forwardly of the front beam 21. The panel 24 provides a rigid support for a floor tray 25 made as a thermoformed moulding in suitable synthetic plastics material.

In the present example, an underfloor water tank 26 is disposed between the intermediate and front members 21, beneath the plywood panel 24 but, as hereinafter described in more detail, this underfloor water tank may be omitted depending upon the facilities required in the portable toilet.

Figure 3:
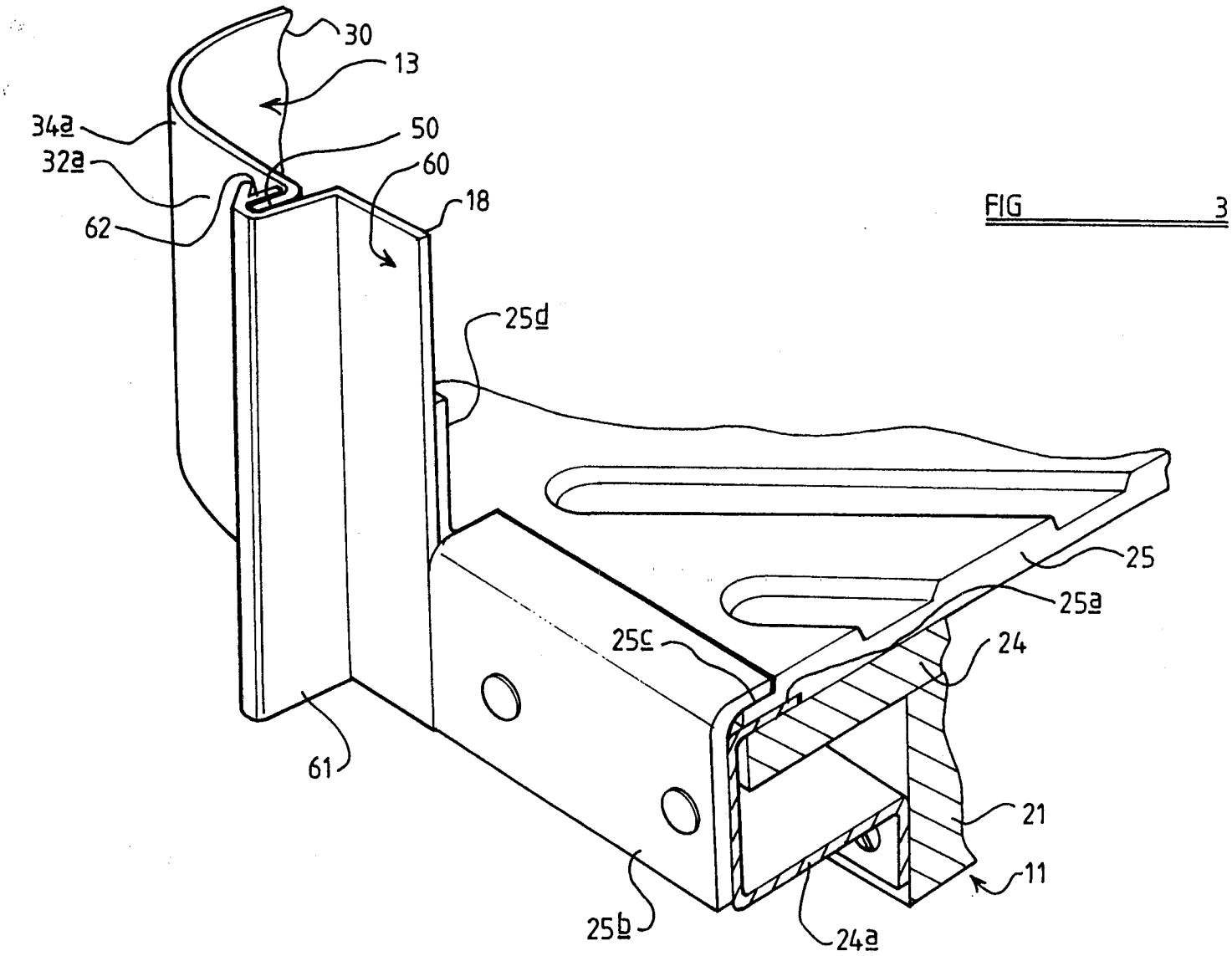
FIG. 3 is a fragmentary perspective view, to an enlarged scale, showing a detail of the door frame of the cabin of FIG. 1.

As best shown in FIG. 3 a folded steel threshold member 24*a* is fastened to the front frame member 21 and has a limb sandwiched between the plywood panel 24 and the floor mat 25 in a rebate 25*a* thereof. A plastic edge trim strip 25*b* is fastened by rivets to the threshold member 24*a* and has an inturned lip which is received within a further rebate 25*c* of the mat 25. The mat 25 has upwardly extending portion 25*d* which engage the inwardly facing surfaces of the side and rear wall members and thus ensures a water tight tray which extends a sufficient distance up the side and rear wails to prevent any liquid which falls onto the floor leaking between the mat and the above mentioned internal surfaces.

A pair of timber skid members 27 are fastened to and beneath the side members 20 to act as skids for manipulating the unit during transport and positioning on site and the like and to protect the underside and provide rigid members for engaging the ground or other supporting surface on which the portable toilet is supported in use.

The first and second side wall members 13 and 14 and the rear wall member 15 are made by vacuum forming a suitable synthetic plastics material such as H.T. polyethylene or, if desired, any other suitable thermoformable plastics material. The wall members have a material thickness of about 3 mm although of course the thickness may be varied as appropriate depending upon the plastics material used.

The roof member 12 is moulded in a suitable synthetic plastics material such as H.T. polyethylene or, if desired, any other suitable thermoformable plastics material. The roof has a material thickness of about 3 mm but again the thickness of the roof may be varied as appropriate depending upon the material of which the roof is made.

As can be seen from FIG. 2, the base frame 11 is rectangular having a greater width than its front rear dimension. In the present example the base frame is 1119 mm wide and 840 mm from front to rear. The skids 27 are dimensioned and positioned so that their lateral overall dimension is equal to their overall front to rear dimension, this dimension in the present example being 1195 mm and hence the overall "footprint" of the unit is square.

The side wall panels 13, 14 define not only, in a portion 30, 31 thereof, a side wall but also a return portion of the front wall and the rear wall as shown at 32*a*, 32*b* for the front wall and 33*a*, 33*b* for the rear wall as well as corner portions 34*a*, 34*b*, 35*a*, 35*b* respectively therebetween.

The remainder of the front wall is provided by the door 16 and its associated frame 18 whilst the remainder of the rear wall is provided by the rear wall member 15 and its associated rear wall frame 17.

In addition, the roof member 12 defines a generally flat rectangular part 40 and has a peripheral flange 41 which defines a roof proper 40 as well.

The side wall members 13, 14 are provided with four horizontally extending channels 45 for rigidifying and styling purposes as well as a recessed portion 46 provided with vertical channel portions 47 which provide hand grips for manipulating the cabin, for example, off a vehicle on which it has been transported to site.

The side wall members 13, 14 have upright joining flanges 50 which cooperate with upright joining flanges 51 provided on opposite sides of the rear wall panel 15.

Figure 5:
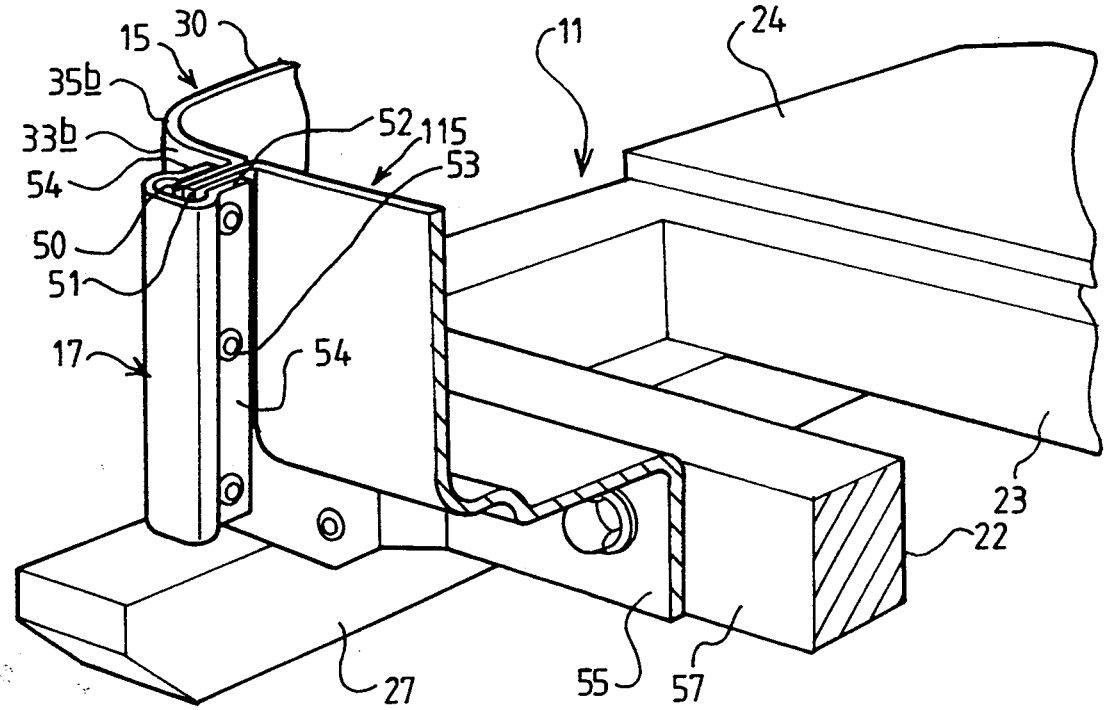
FIG. 5 is an enlarged perspective view showing a detail of a rear to side wall connection of the cabin of FIG. 1.

As best shown in FIG. 5, the flanges 50, 51 are disposed side-by-side and are received in a reduced cross-section mouth 52 of the rear wall frame 17 which is of generally channel configuration. Suitable fasteners such as rivets 53 are provided to extend between limbs 54 of the frame 17 and through the adjacent flanges 50, 51 to secure the side wall members 13, 14 to the rear wall member 15 so that the frame 17 acts to reinforce the joint and also to trim the joint.

At their lower ends, the side wall members 13, 14 and the rear wall member 15 have joining flanges 55. The joining flanges 55 and the side wall members 13, 14 have-a main part which extends parallel to the respective side wall 30, 31 and secondary flanges 56 which extend at right angles to the flange 55.

The flanges 55, 56 are arranged to overlie the vertical side surfaces 57 of the base frame 11 and are fastened thereto by suitable fasteners such as bolts received in opening 42.

As best shown in FIG. 3 the door frame 18 is of generally angle configuration and is formed to provide a rebate 60 in which the door member 16 is received. An outwardly projecting limb 61 is provided with an inwardly facing channel 62 in which the upright joining flange 50 of the side wall members 13, 14 is received and fixed therein by suitable fasteners such as rivets.

The frame 18 thus rigidities the edge of the front return wall parts 32*a*, 32*b* provided by the side wall members 13, 14 as well as trimming the door opening and functioning as a conventional door frame.

The channel 62 of the door frame 18 and the channel 52 of the rear wall frame 17 are of the same overall dimensions but different width so that the side wall panels 13, 14 can be identical. In addition, the rear wall member 15 is of substantially the same size as the door 16 and therefore from an aesthetic point of view when the door 16 is closed, the cabinet has a symmetrical visual appearance.

The rear wall frame 17 and the door frame 18 project above the top of the side walls 30, 31 and above the parts of the front and rear return walls 32*a*, 32*b*; 33*a*, 33*b* provided on the side wall members 13, 14. The flange 41 of roof member 12 is provided with a pair of recesses having an outwardly projecting joining flange 65 at its front and rear which are received in a top part of the respective channel 52, 62 of the rear wall frame 17 and door frame 18 respectively and are fastened thereto by fasteners in a similar manner to the joining flanges 50 described hereinbefore.

The rear wall frame 17 and door frame 18 serve both to connect the roof member 12 to the side wall members 13, 14 and to the rear wall member 15 which has a upper joining flange, not shown, which is received within the channel 52 of the rear wall frame 17 alongside the respective flange 65 of the roof member 12.

Figure 4:
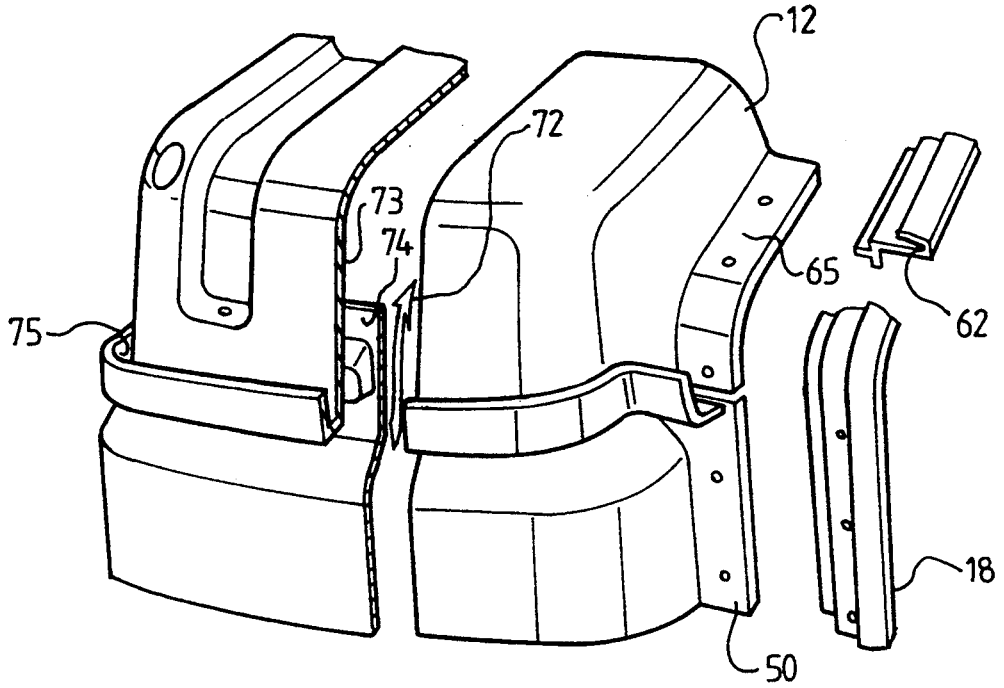
FIG. 4 is a fragmentary perspective view showing a detail of a roof to side connection of the cabin of FIG. 1.

As best shown in FIG. 4, the door frame 18 receives the flange 50 and the flange 65 of the respective side wall members 13, 14 and roof member 12 in its channel 62 and the flanges 50, 65 are fastened therein by suitable fasteners such as rivets.

At their upper ends, the side wall members 13, 14 are provided with inwardly inset portions 44 which project above the side walls 30, 31 and each portion 44 has three outwardly projecting formations 66. The roof member 12 is provided with two channels 67 which terminate in horizontal surfaces 68 at opposite ends.

The horizontal surfaces 68 are positioned to overlie and rest on upwardly facing surfaces 69 of two outer projecting formations 66 and suitable fastenings are passed through apertures provided therein to secure the roof in position. In addition, a suitable fastener is passed through an opening 70 provided in the roof member 12 to pass through a corresponding opening provided in an upright surface 71 of the middle one of the projecting formations 66.

Because the projecting formations 66 are provided on the inwardly inset parts 44 of the side wall members 13, 14 air gaps are provided between the internal surface 73 of the roof member 12 and the outwardly facing surface 74 of the inset part 44 thereby providing ventilation channels 72 between the projecting formations 66 as shown in FIG. 4.

The roof member 12 is provided with a drainage channel 75 around its periphery.

Because the side wall members 13, 14 have corner portions and provide the front and rear return walls, they give the unit considerable strength since the corners are rigidly defined particularly having regard to a generally horizontal shoulder 57 provided at the bottom of each side wall member which extends not only transversely of the side wall part 30, 31 but also around the corner parts **34*a*, 34*b*, 35*a*, 35*b* and the front and rear return wall parts 32*a*, 32*b*, 33*a*, 33*b* thereby providing a rigidly defined corner structure further strengthened by rebate portions 58 which receive corner parts 21*a* of the front of the plywood panel 24**.

In addition there is similar horizontally extending shoulder 59 provided at the top end of each side wall 13, 14 which similarly extends not only over the side wall parts 30, 31 but also around the corner and front and rear return wall parts **34*a*, 34*b*, 35*a*, 35*b*, 32*a*, 32*b*, 33*a*, 33*b***.

The door 16 is constructed as a vacuum formed double skin door comprising an interior skin 80 and an exterior skin 81 fastened together by a two-part extruded aluminium frame comprising an outer part 82 and an inner part 83. The outer part 82 is provided with a channel 84 in its base part in which a torsion spring member 85 is received. Conventional flap hinges 86 are fastened to the frame at appropriate positions and to the limb 61 of the door frame 18.

Figure 6:
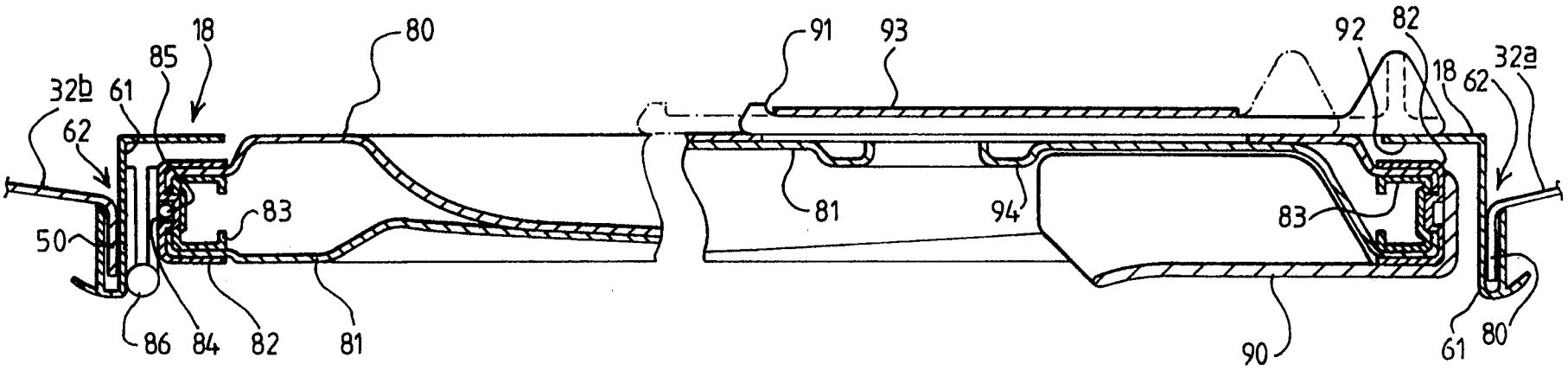
FIG. 6 is a cross-sectional view, to an enlarged scale, on the line 6—6 of FIG. 1.

A suitable exterior door handle 90 is fastened to the frame 82, 83 by suitable fasteners and an internal door catch is provided comprising a slider 91 movable from an inoperative position shown in chain dotted line in FIG. 6 to an operative position-shown in full line in FIG. 6 in which it overlies the other limb 92 of the door frame 18.

The catch 91 is guided for such sliding movement by being received in a passage provide by an offset portion 93 of the inner door skin 80 whilst the outer door skin 81 is provided with reinforcing formations 94 in this region.

As best shown in FIG. 2, the torsion spring 85 has a main part 95, and upper, first and lower, second, transversely extending parts 96, 97 respectively. The main part 95 lies in the hereinbefore mentioned channel 84 and is retained therein by two of the hinges 86. If desired, a separate retaining member may be provided instead of or additional to one or both of the hinges 86.

The upper transversely extending part 96 extends within the door between the inner and outer skins. The lower transversely extending part 97 has a first limb **97*a* which extends beneath the frame member 21 and a horizontally, transversely, extending third part 97*b* which has a curved shape to engage an abutment member 97*c* fixed to the underside of the plywood panel 24. The abutment member 97*c* preferably comprises a roller element which may be grooved to receive the limb 97*a* and part 97*b***.

When the door is opened the limb **97*a* slides past the member 97*c* which, if it is a roller may rotate to reduce friction and noise, and the reaction therebetween provides a door closing force. When the transversely extending third part 97*b* engages the member 97*c*** movement of the door is arrested.

It is to be noted that the torsion spring can easily be removed simply by removing the hinge or hinges 86 and/or other retaining members where provided and then lifting the torsion spring out of the groove.

The door frame 18, door 16, and torsion spring 85 may be pre-assembled to provide a sub-assembly which is then assembled to the remainder of the cabin.

Figure 7:
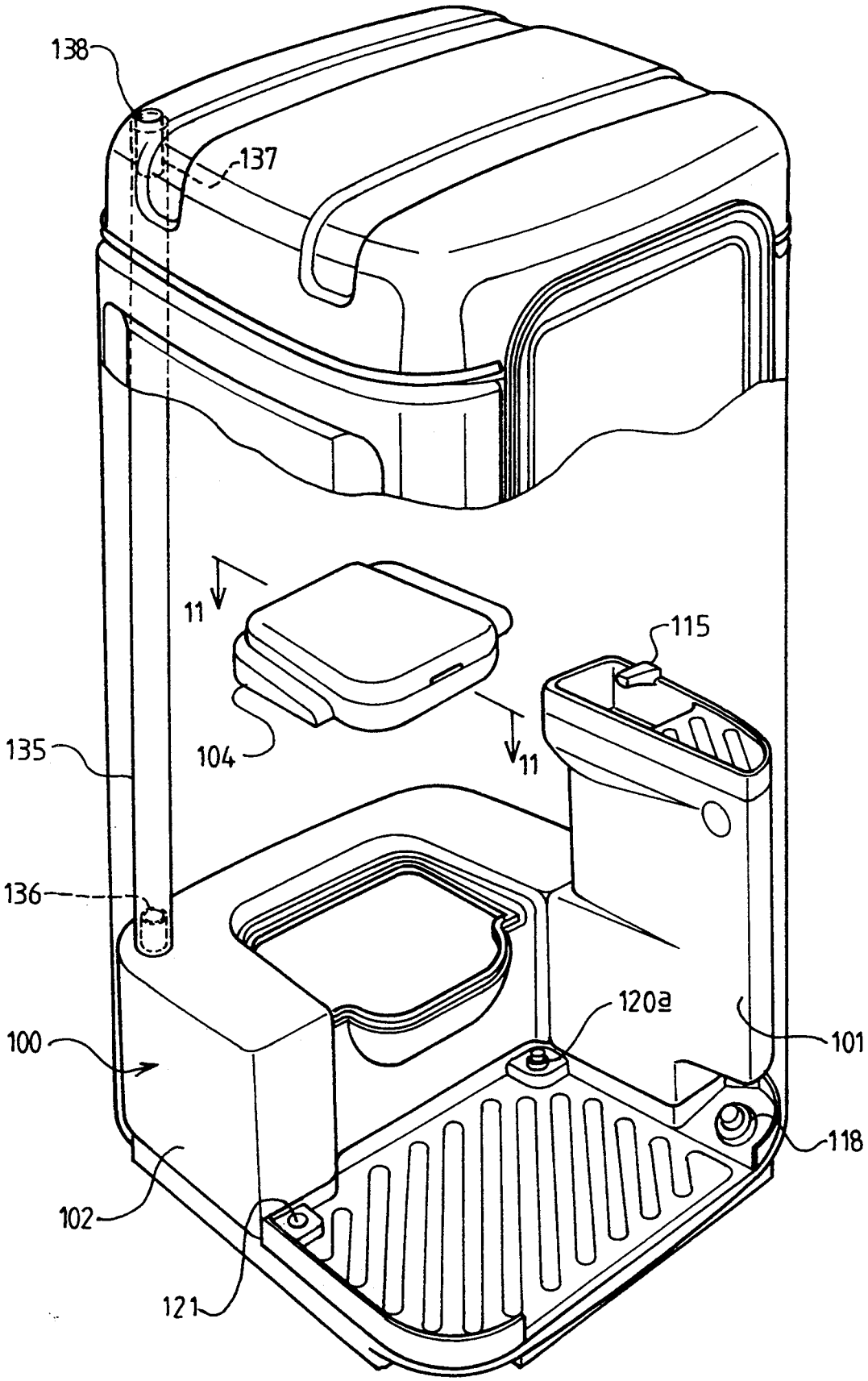
FIG. 7 is a broken-away perspective view of the cabin of FIG. 1 showing the interior thereof.
Figure 10:
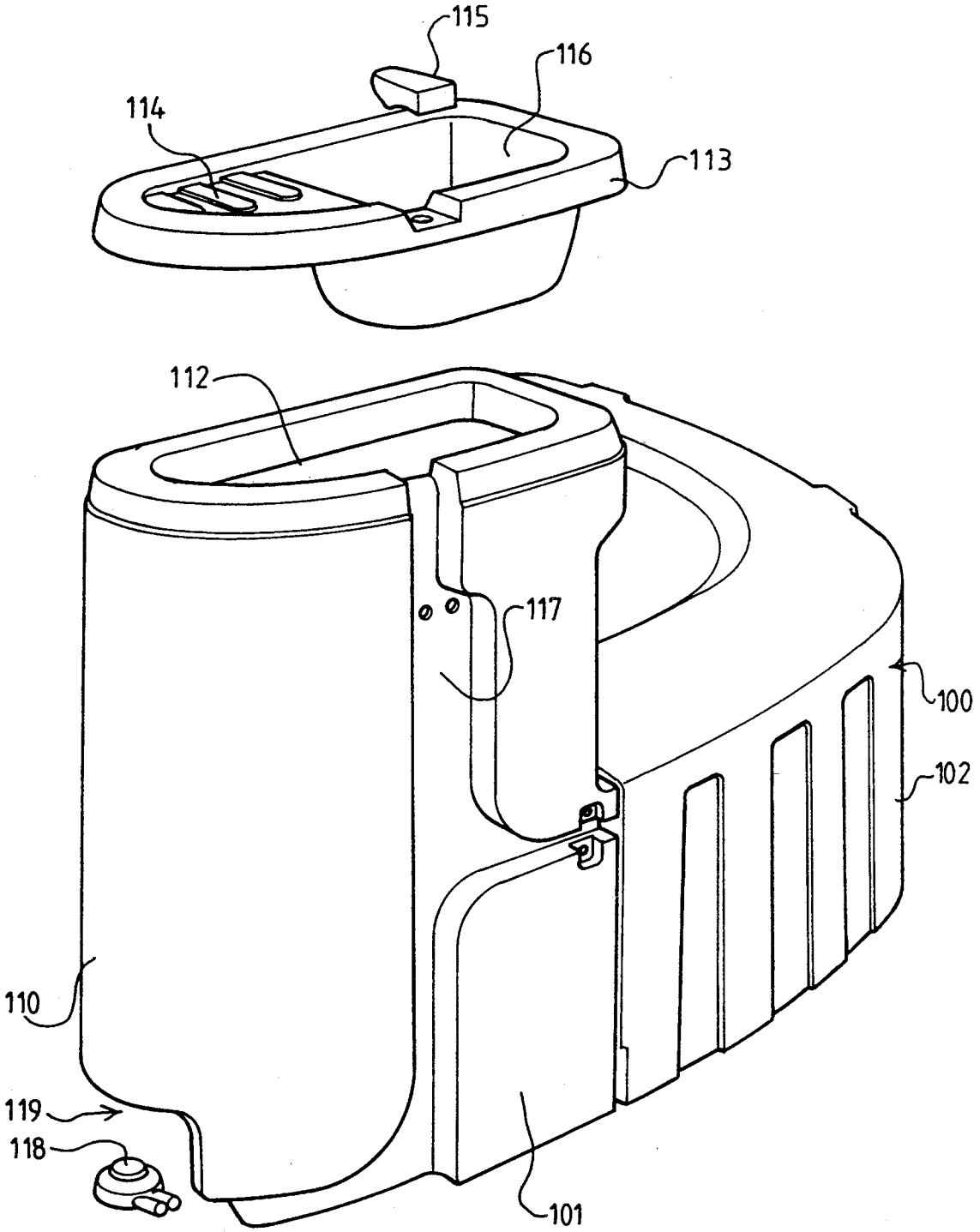
FIG. 10 is a perspective view showing part of a sanitary assembly for use in the cabin of FIG. 1.
Figure 11:
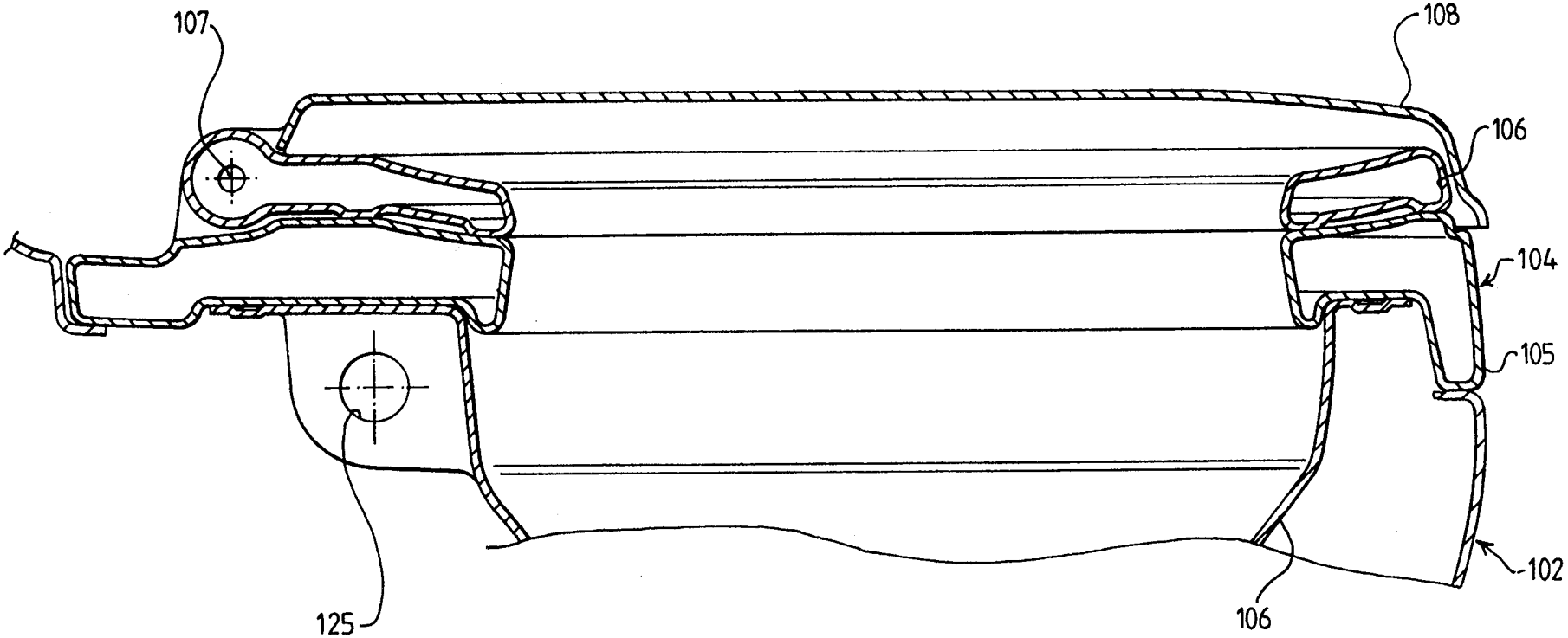
FIG. 11 is a cross-sectional view, to an enlarged scale, on the line 11—11 of FIG. 7.

Referring now to FIG. 7, the cabin is fitted with a sanitary assembly which comprises a W.C. module 100 and a sink module 101. As best shown in FIGS. 10 and 11 the W.C. module 100 comprises a base part 102 which provides a tank 103 therein and a seat assembly 104 arranged to be mounted on the base part 102 and suitably fastened thereto.

The seat assembly 104 comprises a body part 105 to which a bowl part 106 is attached. The configuration of the bowl part 106 may be varied depending upon the toilet function required as hereinafter described in more detail.

The seat assembly 104 also comprises a seat 106 adapted to be sat upon by a user which is pivotally connected to the body part 105 as shown at 107. Also connected to the part 105 at 107 is a lid 108, which may be omitted if desired.

The sink 101 comprises a base part 110 which houses a second water tank 111 and which has an opening 112 at its upper end in which a wash basin 113 is received. The wash basin 113 has a draining board portion 114 and a sink 116. A faucet 115, formed separately from the wash basin 113, is directly connected to a wall of the cabin above the wash basin 113.

The parts of the sanitary assembly described hereinbefore are moulded in suitable synthetic plastics material.

The rear side of the base part 110 which, in use, is adjacent a side wall of the cabin is provided with a recessed portion 117 for pipework and a suitable foot pump 118 is provided in a cut out part 119 of the base part 110.

A foot pump 120 is provided in the base part 102 of the W.C. assembly 100 and has a foot engageable operating member 120*a* (FIG. 7).

Figure 8:
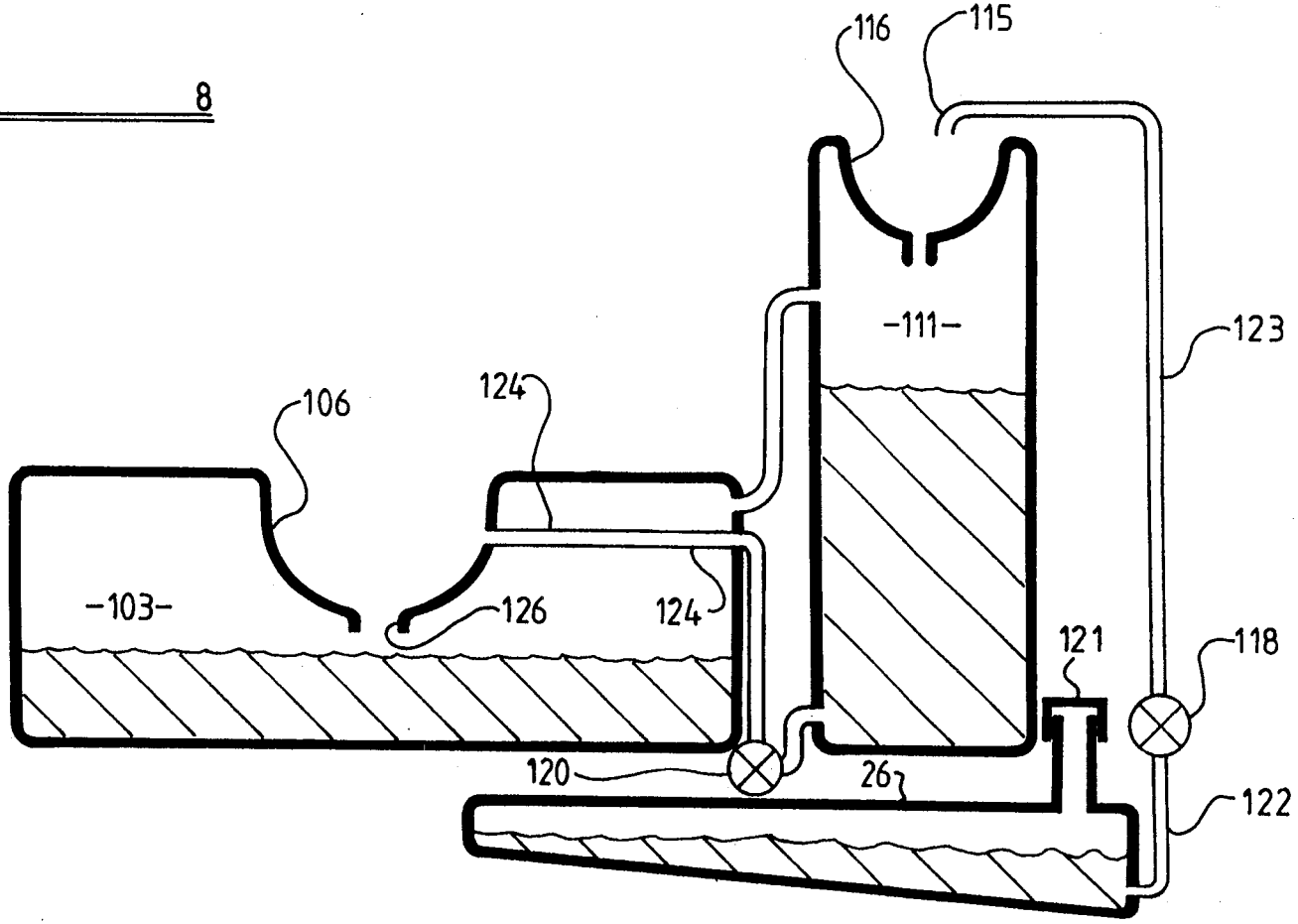
FIG. 8 is a diagrammatic illustration of one plumbing arrangement suitable for use in the cabin of FIG. 1.

Referring now to FIG. 8, in use, the under floor tank 26 is filled with fresh water by means of a vented filler cap 121 and the tank 26 is connected by a pipe 122 to the foot pump 118 the outlet of which is connected by a pipe 123 to the faucet 115.

Used water from the sink 116 is discharged into the second water tank 111 which thus contains "grey" water. A pipe 124 extends from a position adjacent the lower end of the tank 111 to the foot pump 120 from which water is delivered by a pipe 124 to flush the bowl 106.

The pipe 124 extends to a flushing manifold 125 formed integrally with the bowl 106.

The contents of the bowl 106 are discharged via an opening 126 into the third tank 103. The tank 103 is usually pre-filled with a suitable amount of sanitary liquid in conventional manner.

If desired a hand pump may be substituted for either or both of the foot pumps 118, 120.

Figure 9:
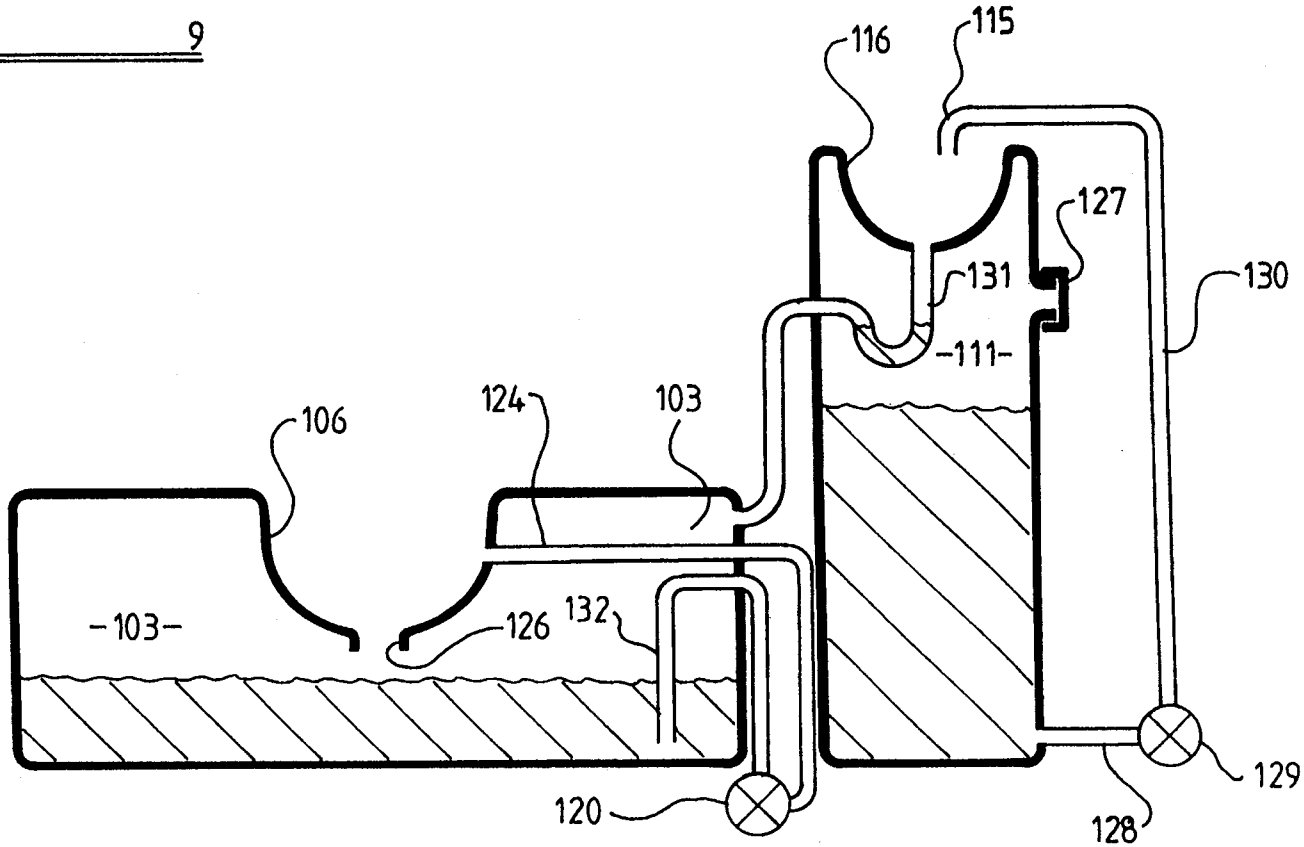
FIG. 9 is a diagrammatic illustration of an alternative plumbing arrangement for use in the cabin of FIG. 1.

In a modification, shown in FIG. 9, the toilet unit is not provided with an underfloor tank 26. In this case the tank 111 is filled with fresh water through an inlet 127 and fresh water is fed by a pipe 128 to a foot pump 129 from which fresh water is delivered by a pipe 130 to the faucet 115.

Used water from the sink 116 is discharged via a water trap 131 to the tank 103 from which liquid is withdrawn via a pipe 132 by the pump 120 and fed by the pipe 124 to flush the bowl 106. The contents of the bowl are discharged via opening 126 back into the tank 103 to be recycled.

If desired, instead of providing the plumbing arrangements described hereinbefore with reference to FIGS. 8 and 9, other plumbing arrangements are possible.

For example, the toilet flushing arrangement may be completely independent of the wash basin. In this case, there would be no connection such as shown at 131 in FIG. 8 and the tank 103 would be pre-filled with water and a suitable sanitary liquid and the toilet bowl 106 flushed using the pump 120 by recirculating the liquid in the tank 103.

In this case, the cabin may be unprovided with any wash basin facility should that be desired, or the wash basin facility can be provided separately and the waste water from the wash basin may be discharged to the exterior of the unit or to a separate holding tank suitably disposed.

For example, the holding tank could be disposed beneath the floor in a similar position to the tank shown at 26 in FIG. 9. In this case the grey water, i.e. the used wash basin water, could be stored in a tank corresponding to the tank 26 and fresh water for hand washing stored in the tank 111 with a pipe and pump analogous to the pipes 122, 123 and pump 128 and used for feeding water from the tank 111 to the faucet.

An alternative configuration may also be provided in the arrangement of FIG. 8 in which the grey water is stored in the tank 26 and the fresh water in the tank 111.

In a further alternative the toilet bowl 106 may be provided with a conventional U-bend water trap and connected directly into a "mains" type discharge pipe which may discharge into a municipal type sewage disposal system or into a private disposal system such as a septic tank or a cesspit.

In this case, water for flushing may be supplied from a fresh water supply to the cabin from an external source or the tank 103 may be filled with water for flushing but not to receive any discharge from the bowl. Alternatively, fresh water for flushing may be stored in some other tank in the unit at an appropriate position.

In all embodiments, the module 102 containing the tank 103 is provided since this provides structure integrity to the unit and avoids the need to provide different internal mouldings for different plumbing configurations it being simply necessary to change the form of toilet bowl, for example by providing an alternative seat assembly 104.

The bowl 106 is made of plastics material which minimises the weight and is convenient and hygienic to provide. If desired however, it may be made of other materials such as china, aluminium or stainless steel.

It will be noted that the toilet bowl projects forwardly of the module 102 providing the tank 103 so that the toilet bowl collects drips in use thereby avoiding drips running down the front of the tank and onto the floor.

A stack pipe 135 is disposed so as to encircle, at its lower end, a spigot 136 projecting upwardly from the tank 103 and encircling, at its upper end, a spigot 137 depending downwardly from the roof which is provided with an opening 138 to provide communication, through the stack pipe 135 between atmosphere and the interior of the soil tank 103.

The features disclosed in the foregoing description, or the accompanying drawings, expressed in their specific forms or in terms of a means for performing the disclosed function, or a method or process for attaining the disclosed result, or a class or group of substances or compositions, as appropriate, may, separately or in any combination of such features, be utilised for realising the invention in diverse forms thereof.

I claim:

1. A cabin comprising a base structure, a wall structure comprising opposed spaced apart side walls and, extending between said side walls a front wall and a spaced apart, opposed, rear wall and a roof structure, wherein the wall structure comprises two opposed side wall members which define said two opposite side walls of the cabin and which each provide a pair of corners and a pair of return walls which define a part only of said front and rear walls of the cabin so as to define a space between adjacent return walls, the space between the rear return walls being closed by a rear wall member and the space between the front return walls being closable by a door wherein the cabin includes a rear wall frame, within which the rear wall member is disposed, and the rear wall frame is connected to the rear wall member and to the rear return walls, and a door frame, defining an opening which is closable by the door, and the door frame is connected to the front return walls.

2. A cabin according to claim 1 wherein the distance between the rear return walls is the same as the space between the front return walls.

3. A cabin according to claim 1 wherein the side wall members are provided with recessed vertically extending channel portions to provide hand engageable portions to facilitate manipulation of the unit.

4. A cabin according to claim 1 wherein the door comprises a vacuum formed double skin door with the skins of the door being held in a frame.

5. A cabin comprising a base structure, a wall structure and a roof structure, wherein the wall structure comprises two opposed side wall members which define two opposite side walls of the cabin and which each provide a pair of corners and a pair of return walls which define a part of front and rear walls of the cabin, the space between the rear return walls being closed by a rear wall member and the space between the front return walls being closable by a door, wherein the cabin includes a rear wall frame, within which the rear wall member is disposed, and the rear wall frame is connected to the rear wall member and to the rear return walls, a door frame defining an opening which is closable by the door, and the door frame is connected to the front return walls and wherein the rear wall frame and the door frame extend above the top of the front and rear return walls and have a top portion which is connected to the roof structure.

6. A cabin comprising a base structure, a wall structure and a roof structure, wherein the wall structure comprises two opposed side wall members which define two opposite side walls of the cabin and which each provide a pair of corners and a pair of return walls which define a part of front and rear walls of the cabin, the space between the rear return walls being closed by a rear wall member and the space between the front return walls being closable by a door and wherein the roof structure is connected to inwardly inset portions of the side wall members which project above the top of the side walls, said inwardly inset portions having outwardly extending projecting parts which engage with the roof structure and to which the roof structure is secured by suitable fastening means and a space being provided between the outwardly projecting portions and adjacent parts of the roof structure and the inwardly inset portion to provide ventilation channels between the interior of the cabin and the exterior.

7. A cabin comprising a base structure, a wall structure comprising opposed spaced apart side walls and, extending between said side walls a front wall and a spaced apart, opposed, rear wall and a roof structure, wherein the wall structure comprises two opposed side wall members which define said two opposite side walls of the cabin and which each provide a pair of corners and a pair of return walls which define a part only of said front and rear walls of the cabin so as to define a space between adjacent return walls, the space between the rear return walls being closed by a rear wall member and the space between the front return walls being closable by a door wherein the base structure comprises a generally rectangular frame to which the side wall members and the rear wall member are fastened and comprises a floor panel which is slightly offset from the frame and there is a slight overhang of the panel over a front member of the frame.

8. A cabin comprising a base structure, a wall structure and a roof structure, wherein the wall structure comprises two opposed side wall members which define two opposite side walls of the cabin and which each provide a pair of corners and a pair of return walls which define a part of front and rear walls of the cabin, the space between the rear return walls being closed by a rear wall member and the space between the front return walls being closable by a door, wherein the cabin includes a rear wall frame, within which the rear wall member is disposed, and the rear wall frame is connected to the rear wall member and to the rear return walls, a door frame defining an opening which is closable by the door, and the door frame is connected to the front return walls, wherein the rear wall frame is provided with a generally channel-shaped portion in which outwardly projecting flange portions of the side wall members and rear wall member and roof member are received in side-by-side relationship.

9. A cabin according to claim 8 wherein the free edges of the return front and side walls of each side wall panel have said flange extending outwardly generally perpendicular thereto and the rear wall member, along its vertical side edges and top edge, is provided with said flange which extends generally perpendicularly to the remainder of the rear wall member.

10. A cabin comprising a base structure, a wall structure and a roof structure, wherein the wall structure comprises two opposed side wall members which define two opposite side walls of the cabin and which each provide a pair of corners and a pair of return walls which define a part of front and rear walls of the cabin, the space between the rear return walls being closed by a rear wall member and the space between the front return walls being closable by a door, wherein the cabin includes a rear wall frame, within which the rear wall member is disposed, and the rear wall frame is connected to the rear wall member and to the rear return walls, a door frame defining an opening which is closable by the door, and the door frame is connected to the front return walls, wherein the roof member has a generally flat main part with a peripheral and downwardly extending flange formed at the periphery which overlies inwardly offset upper edge portions of the side wall members, and the peripheral flange of the roof being provided with recessed parts, to receive the rear wall frame and door frame and the recessed parts being provided with an outwardly extending flange for joining to the rear wall frame and door frame.

11. A cabin comprising a base structure, a wall structure and a roof structure wherein the wall structure comprises a door pivotally connected in a door frame and torsion spring means being provided to bias said door towards a closed position, the torsion spring means comprising a main part extending generally parallel to the axis of pivot of the door and first and second transversely extending parts disposed at opposite ends of the main part and extending transversely away therefrom and being in abutting relationship with the door and cabin respectively so as to bias the door towards said closed position and wherein the door comprises an edge member having an outwardly facing surface in which is provided a longitudinally extending groove in which said main part is received, the main part of the torsion spring being retained in said groove by retaining means.

12. A cabin according to claim 11 wherein the retaining means comprises at least one hinge member for the door, said hinge member being secured to said outwardly facing surface.

13. A cabin according to claim 11 wherein the first transversely extending part extends through an opening in the wall of the groove.

14. A cabin comprising a base structure, a wall structure and a roof structure wherein the wall structure comprises a door pivotally connected in a door frame and torsion spring means being provided to bias said door towards a closed position wherein the torsion spring means comprises a main part retained in a longitudinal extending groove on an outwardly facing surface of said door extending generally parallel to the axis of pivot of the door and first and second transversely extending parts disposed at opposite ends of the main part and extending transversely away therefrom and being in abutting relationship with the door and cabin respectively so as to bias the door towards said closed position and the second transversely extending part of the torsion spring means being in sliding engagement with the cabin as well as in said abutting relationship therewith and being provided with a stop means to limit opening of the door, the stop means comprising a third part which extends transversely of the second part and is adapted to engage an abutment on the cabin.

15. A cabin according to claim 14 wherein the first transversely extending part extends through an opening in the wall of the groove.

16. A cabin comprising a base structure, a wall structure and a roof structure wherein the wall structure comprises a door pivotally connected in a door frame and torsion spring means being provided to bias said door towards a closed position, wherein the torsion spring means comprises a main part extending generally parallel to the axis of pivot of the door and first and second transversely extending parts disposed at opposite ends of the main part and extending transversely away therefrom and being in abutting relationship with the door and cabin respectively so as to bias the door towards said closed position and wherein the door comprises an edge member having an outwardly facing surface in which is provided a longitudinally extending groove in which said main part is received, the main part of the torsion spring being retained in said groove by retaining means and the second transversely extending part of the torsion spring means being in sliding engagement with the cabin, as well as in said abutting relationship therewith, and being provided with a stop means to limit opening of the door, the stop means comprising a third part which extends transversely to the second part and is adapted to engage an abutment on the cabin.

17. A cabin according to claim 16 wherein said retaining means comprises at least one hinge member for the door, said hinge member being secured to said outwardly facing surface and said transversely extending part extending through an opening in the wall of the groove.

* * * * *